US007686001B2

(12) United States Patent
Fitt

(10) Patent No.: US 7,686,001 B2
(45) Date of Patent: Mar. 30, 2010

(54) THROWING APPARATUS

(75) Inventor: Carl Douglas Fitt, 4/27 Holgate Road, Kohimarama, Auckland (NZ)

(73) Assignees: Carl Douglas Fitt, Auckland (NZ); Warwick Spedding Lewis, Auckland (NZ)

( * ) Notice: Subject to any disclaimer, the term of this patent is extended or adjusted under 35 U.S.C. 154(b) by 369 days.

(21) Appl. No.: 11/712,463

(22) Filed: Mar. 1, 2007

(65) Prior Publication Data

US 2008/0072885 A1 Mar. 27, 2008

(30) Foreign Application Priority Data

Sep. 21, 2006 (NZ) ..... 550015

(51) Int. Cl.
*F41B 3/00* (2006.01)

(52) U.S. Cl. ..... 124/5

(58) Field of Classification Search ..... 124/5
See application file for complete search history.

(56) References Cited

U.S. PATENT DOCUMENTS

| | | | | | |
|---|---|---|---|---|---|
| 651,222 | A | * | 6/1900 | Wharton | 473/509 |
| 1,530,573 | A | * | 3/1925 | Olcott | 473/513 |
| 1,607,874 | A | * | 11/1926 | Darton | 124/5 |
| 3,589,349 | A | * | 6/1971 | Parker | 124/5 |
| 4,076,004 | A | * | 2/1978 | Huelskamp | 124/5 |
| 6,076,829 | A | * | 6/2000 | Oblack | 273/317 |

* cited by examiner

*Primary Examiner*—John Ricci
(74) *Attorney, Agent, or Firm*—Young & Thompson

(57) ABSTRACT

The invention consists in a throwing apparatus comprising an elongated handle and a cup mounted on the handle at or adjacent one end thereof. The cup is shaped to receive a throwable, non spherical, object and to retain such object until the handle is swung whereupon the object is released from the cup.

12 Claims, 2 Drawing Sheets

THROWING APPARATUS

This invention relates to throwing apparatus and in particular manually operated throwing apparatus.

Throughout the description and claims of this specification the word "comprise" and variations of that word, such as "comprises" and "comprising", are not intended to exclude other additives, components, integers or steps.

BACKGROUND OF THE INVENTION

It is often desired for play, relaxation, pleasure or sporting competition to throw a throwable object significant distances. Where the object is not spherical the difficulty of throwing is increased as it is necessary to hold the throwable object in particular ways to achieve distance for example by making the throwable object spin in flight.

Accordingly, there is a need for a means which will enable non spherical objects such as some balls to be thrown a maximum distance.

SUMMARY OF THE INVENTION

It is therefore an object of the person invention to provide a throwing apparatus and/or a method of throwing which will go at least someway towards meeting the foregoing desiderata in a simple yet effective manner or which will at least provide the public with a useful choice.

Accordingly, in one aspect the invention consists in a throwing apparatus comprising an elongated handle and a cup mounted on the handle at or adjacent one end thereof, the cup being shaped to receive a throwable, non spherical, object and to retain such object until the handle is swung whereupon the object is released from the cup.

Preferably the cup has an inner face which is part of the surface of a vesica piscis, ellipsoid, or prolate spheroid.

Preferably the cup is formed of a plastic material.

Preferably the cup is open at each end.

Preferably the handle is curved.

Preferably the angle between the axis of the handle, at the point of attachment, and the direction of movement of the object immediately it leaves the cup is approximately a right angle.

Preferably the handle is able to be rotated in the user's hand.

In a further aspect the invention consists in a method of throwing a non spherical object comprising the steps of holding the handle of a throwing apparatus according to anyone of the preceding paragraphs, rotating the handle so that the non spherical object is at an angle to the forward face of the user, and swinging the handle in a generally forward direction so that a spin is imparted to the object as it leaves the cup.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTIONS OF THE DRAWINGS

Figure 1:
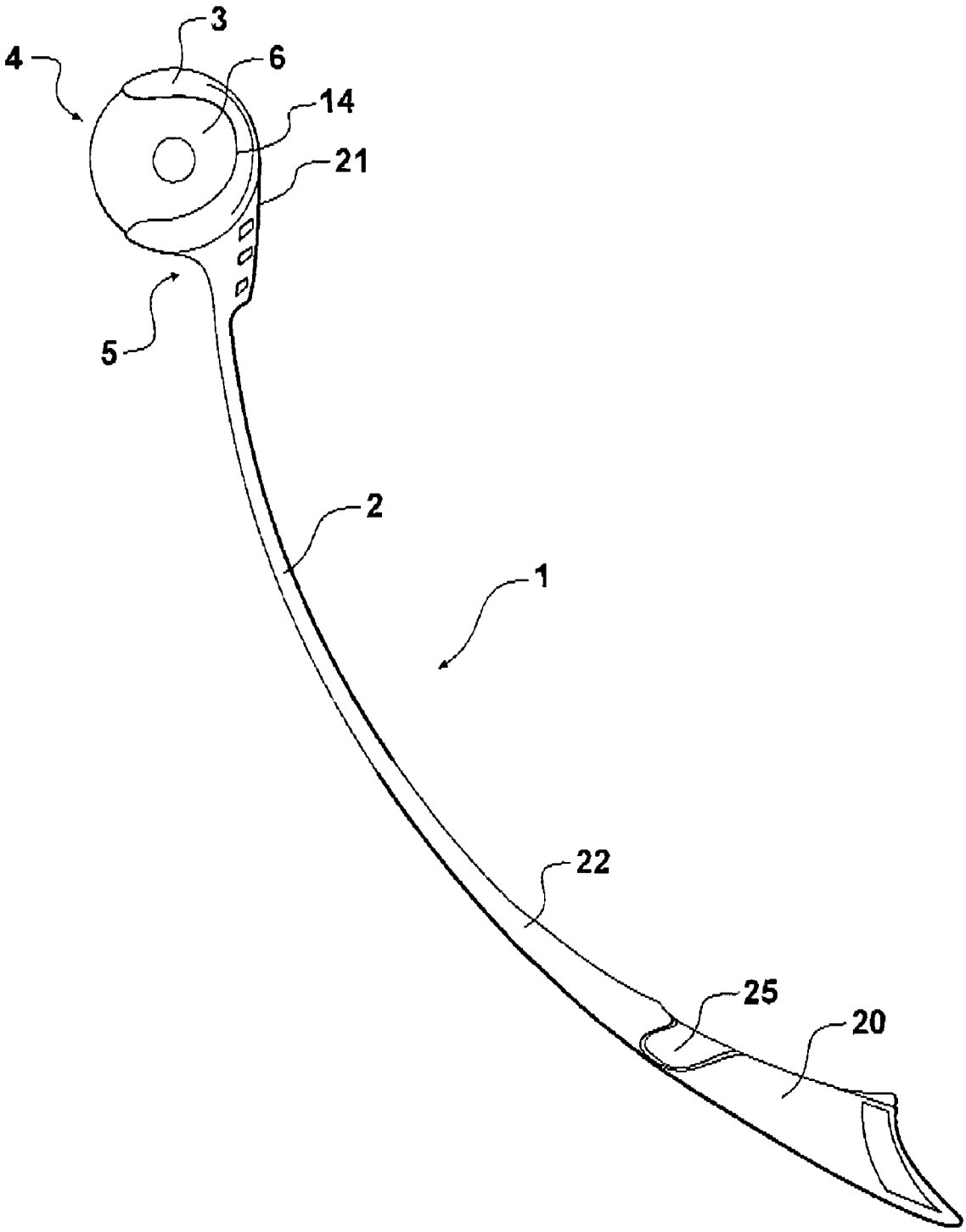
Figure 2:
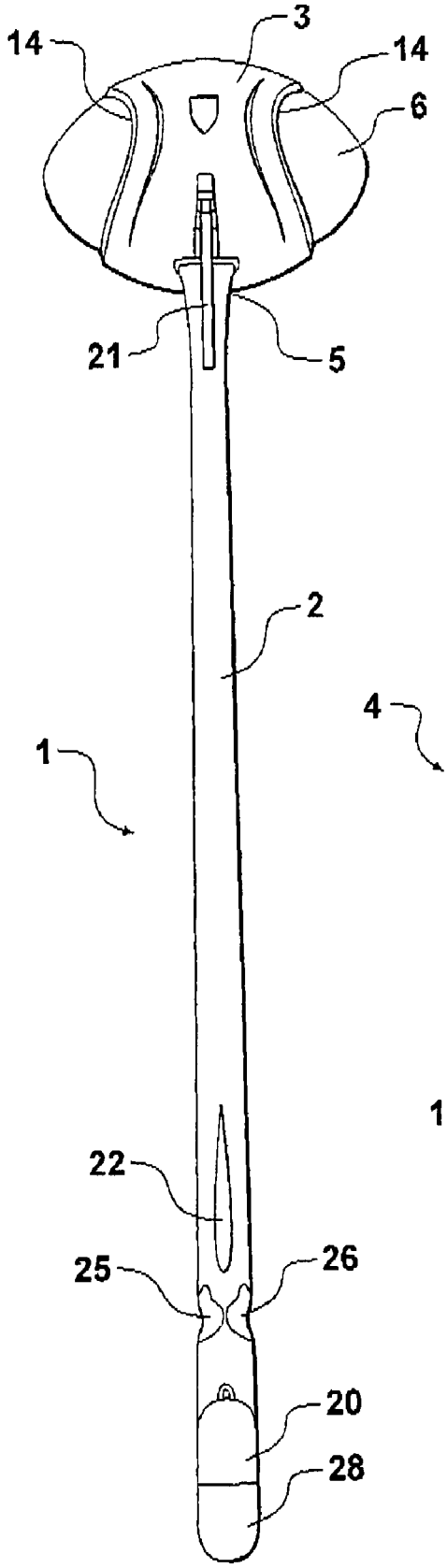
Figure 3:
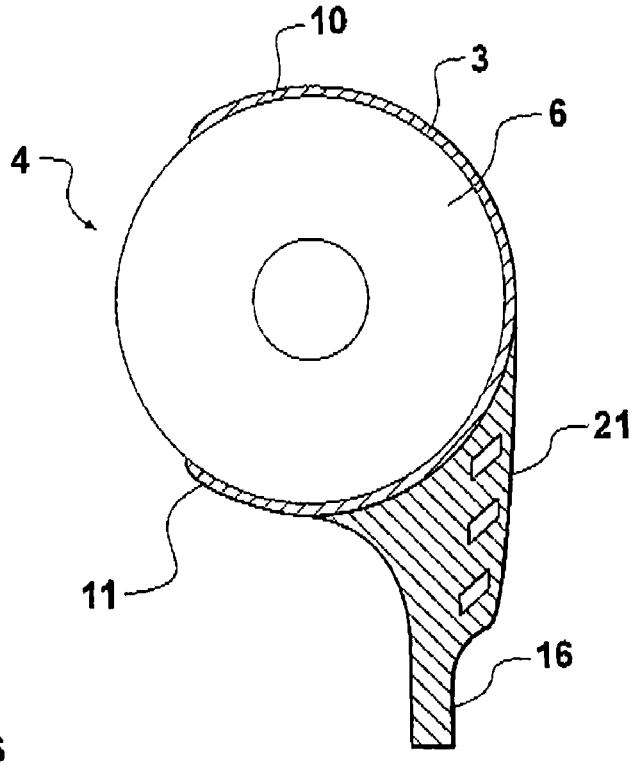

One preferred form of the invention will now be described with reference to the accompanying drawings in which, FIG. 1 is a side elevation of a throwing apparatus according to one preferred form of the invention, FIG. 2 is a rear elevation of the throwing apparatus of FIG. 1, and FIG. 3 is a transverse cross section through a cup forming part of a throwing apparatus according to a preferred form of the invention.

DETAILED DESCRIPTION OF THE PREFERRED EMBODIMENTS

Referring to the drawings a throwing apparatus 1 is provided, which has an elongated handle 2 with a cup 3 mounted thereon.

The elongated handle 2 may be formed of a somewhat stiff plastics material but preferably having some flexibility and be curved along its length.

The length could be any desirable length for example approximately half a meter. The curve can be effected at a consistent rate or can be formed in an other shape as is desired. The purpose of the shape is essentially to enable the device to be held with the handle somewhat upright in a hand of the user whilst at that point the mouth 4 of the cup points substantially directly ahead. To this end the angle at the point of the attachment 5 of the handle 2 to the cup 3 is desirably so that the longitudinal axis of the handle at that point forms substantially a right angle with the direction that the object which will be held in the cup 3 will exit the cup in use.

The cup 3 has, in the preferred form, open ends as can be seen in FIGS. 1 and 2 and is adapted to receive a non spherical object. In the preferred form the inner face of the cup 3 is formed of two parts of a vesica piscis being the shape of the ball used in American football. Accordingly a non spherical object 6 for example a full or smaller version of an American football may be received into the cup 3. The mouth 4 of the cup 3 has a part of the ball 6 protruding therefrom. The shape of the cup 3 is such that the ball 6 will be firmly held therein prior to any throwing action taking place. Other shapes such as an ellipsoid or a prolate spheroid can be used. The cup extends more than 50% of the central circumference of the ball. The exact extent of the circumference held in the cup 3 is empirically determined and will depend on the flexibility of the cup 3.

The cup 3 is formed of a plastic material that is sufficiently stiff to hold the ball in position but which when a significant forward force is applied to the handle, for example by swinging the handle by used of the user's arm, the momentum of the ball as the throwing apparatus looses speed is such that the ball can be forced from the cup by outward movement of the parts 10 and 11 of the cup 3 and/or by distortion of the ball. The inner surface of the cup is preferably a substantially exact complementary moulding of the ball to be thrown.

The trailing inwardly swaged parts 14 (in use) allow spinning of the trailing ball to commence in use. The trailing swaged part 14 allows the ball to turn as the ball leaves the cup 3. Where the throwing apparatus will always be used left handed or right handed the swage 14 need only be provided on the trailing edge of the cup 3.

The handle 2 may be attached to the cup 3 for example by providing a spigot 16 extending from the cup 3 to engage in a longitudinal depression in the handle 2 into which the spigot 16 is fixed. The handle can be fixed in a suitable manner such as by glue or welding or the like. Alternatively the handle and cup can be made in one piece.

The handle 2 and cup 3 may be stiffened if required, for example, by a rib 21 on the cup 3 and a rib 22 on the handle 2 towards the free end thereof.

Cut outs 25 and 26 may be provided at the gripping part of handle 2 which may be engaged in use by the finger and thumb of the user. This aids rotation of the handle 2 in the hand of the user.

Also if desired the free end 20 of the handle may be hollow and covered by a door, flags or other closure 28 to provide a storage area, for example, for plastics bags, car keys or other items.

In use a non spherical object such as an American football is placed into the cup 3. The handle is grasped at the centre of the cup 3, for example the end 20, taken back and swung forwardly. At the end of the swing the ball will force itself from the end 10 of the cup 3 as previously described herein.

In the preferred form the handle is formed to be somewhat spherical or elliptical at the end so that if necessary the handle can be rotated in the hand of the user. Any shape that will enable this to be achieved such as, for example shapes similar to the handle of a tennis racket, may also be used. This allows the handle to be rotated in the hand of the user prior to the forward swing. The effect of this is as the ball exits the cup 3 the end 10 of the cup will tend to act like the fingers of a person throwing the ball and imparts spin to the ball. This spin will enable the throwing action to achieve a greater distance of the ball. The handle in the form above described can be used by both left and right hand users. The cup 3 and handle simulates the left or right handed throwing of a ball and giving a substantially constant release and spin.

Thus it can be seen that in at least the preferred form of the invention a throwing apparatus is provided which will enable a non spherical object such as a football or a smaller version of an American or other non-spherical football to be thrown a significance distance in a simple yet effective manner.

This is advantageous.

What I claim is:

1. A throwing apparatus, comprising:

an elongated handle; and a cup mounted on the handle at or adjacent to one end thereof, the cup being shaped to i) receive a throwable, non-spherical object and to ii) retain the non-spherical object until the handle is swung, whereupon the object is released from the cup, wherein the cup has at least one inwardly swaged area positioned i) so that, in use, a part of the non-spherical object extends outwardly through the inwardly swaged area prior to the object being released from the cup, and ii) so that as the handle is being swung the at least one swaged area becomes a trailing swaged area to impart spin to the object.

2. The throwing apparatus as claimed in claim 1, wherein the cup has an inner face as part of a surface of a vesica piscis, ellipsoid, or prolate spheroid.

3. The throwing apparatus as claimed in claim 1, wherein the cup is formed of a plastic material.

4. The throwing apparatus as claimed in claim 1, wherein the cup is open at each end.

5. The throwing apparatus as claimed in claim 1, wherein the handle is curved.

6. The throwing apparatus as claimed in claim 5, wherein the angle between the axis of the handle, at the point of attachment, and the direction of movement of the non-spherical object immediately as the non-spherical object leaves the cup is approximately a right angle.

7. The throwing apparatus as claimed in claim 1, wherein the handle is configured to be rotated in a user's hand.

8. A method of throwing a non-spherical object, comprising the steps of:

holding the handle of a throwing apparatus according to claim 1;

rotating the handle so that the non-spherical object is at an angle to the forward face of a user; and swinging the handle in a generally forward direction so that a spin is imparted to the non-spherical object as the non-spherical object leaves the cup.

9. The throwing apparatus as claimed in claim 1, wherein the cup has two inwardly swaged areas configured so that, in use, two parts of the non-spherical object extend outwardly through the inwardly swaged areas prior to the non-spherical object being released from the cup, one of the two inwardly swaged areas becoming the trailing swaged area in use.

10. A throwing apparatus, comprising:

an elongated handle (2); and a cup (3) at a free end of the handle (2), the cup comprising a curved portion with a top portion, a bottom portion, and a middle portion connecting the bottom and top portions and narrower than both the top and bottom portions, the curved portion forming a partially enclosed inner space with a forward-facing mouth (4) configured to receive and retain a non-spherical object (6) in the inner space, an inner face of the inner space having a semi-ellipsoid, non-spherical configuration, wherein the curved portion includes at least one inwardly swaged portion (14) at a rearward end of the curved portion configured to turn the non-spherical object (6) when, in use, the non-spherical object (6) is forced from the cup via a forward force applied to the elongated handle, and wherein the mouth (4) formed by the curved portion at the middle portion is open at a first and a second side of the middle portion such that opposite outermost ends of the non-spherical object (6) protrude outside the inner space of the curved portion when the non-spherical object is received and retained in the inner space.

11. The throwing apparatus as claimed in claim 10, wherein two inwardly swaged portions (14) are provided at opposite sides of the rearward end of the curved portion.

12. The throwing apparatus as claimed in claim 10, wherein the curved portion of the cup is configured to extend more than 50% around a central circumference of the non-spherical object (6).

* * * * *